US009945517B2

(12) United States Patent
Fennessy et al.

(10) Patent No.: US 9,945,517 B2
(45) Date of Patent: Apr. 17, 2018

(54) PORTABLE GAS FILLING SYSTEM

(75) Inventors: Craig Fennessy, Huntington Beach, CA (US); Duane Bergmann, Big Bear Lake, CA (US)

(73) Assignee: ACD COMPANY, Santa Ana, CA (US)

( * ) Notice: Subject to any disclaimer, the term of this patent is extended or adjusted under 35 U.S.C. 154(b) by 1600 days.

(21) Appl. No.: 12/555,152

(22) Filed: Sep. 8, 2009

(65) Prior Publication Data

US 2011/0056217 A1 Mar. 10, 2011

(51) Int. Cl.

| | |
|---|---|
| ***F17C 9/02*** | (2006.01) |
| ***F17C 13/00*** | (2006.01) |
| ***B65B 3/04*** | (2006.01) |
| ***B65B 1/04*** | (2006.01) |
| ***F17C 5/06*** | (2006.01) |

(52) U.S. Cl.

CPC ..... *F17C 9/02* (2013.01); *F17C 5/06* (2013.01); *F17C 2201/0109* (2013.01); *F17C 2201/056* (2013.01); *F17C 2203/03* (2013.01); *F17C 2203/0626* (2013.01); *F17C 2205/013* (2013.01); *F17C 2205/0323* (2013.01); *F17C 2205/0338* (2013.01); *F17C 2221/011* (2013.01); *F17C 2223/0161* (2013.01); *F17C 2223/033* (2013.01); *F17C 2225/0123* (2013.01); *F17C 2225/035* (2013.01); *F17C 2227/015* (2013.01); *F17C 2227/0142* (2013.01); *F17C 2227/0311* (2013.01); *F17C 2227/0393* (2013.01); *F17C 2227/044* (2013.01); *F17C 2250/03* (2013.01); *F17C 2250/043* (2013.01); *F17C 2260/02* (2013.01); *F17C 2270/02* (2013.01); *F17C 2270/0509* (2013.01)

(58) Field of Classification Search

CPC .... F17C 13/00; F17C 17/04; F17C 2201/058; F17C 2205/0157; B65B 3/04; B65B 1/04

USPC ..... 62/50.1, 50.2, 50.6, 48.1, 270

See application file for complete search history.

(56) References Cited

U.S. PATENT DOCUMENTS

| | | | | |
|---|---|---|---|---|
| 3,727,651 | A * | 4/1973 | Biever | 141/231 |
| 4,881,374 | A * | 11/1989 | Mattiola et al. | 62/50.6 |
| 5,762,119 | A * | 6/1998 | Platz et al. | 141/231 |
| 5,819,544 | A | 10/1998 | Andonian | |
| 5,924,291 | A | 7/1999 | Weiler et al. | |
| 5,934,081 | A | 8/1999 | Notaro et al. | |

(Continued)

FOREIGN PATENT DOCUMENTS

| | | | | |
|---|---|---|---|---|
| EP | 0706903 A1 * | 6/1995 | | B60B 33/02 |
| WO | WO2008110453 * | 9/2008 | | |

OTHER PUBLICATIONS

Department of Defense Design Criteria Standard, section 4.8.3, MIL-STD-1660, section 4.8.3.*

*Primary Examiner* — Frantz Jules
*Assistant Examiner* — Erik Mendoza-Wilkenfel
(74) *Attorney, Agent, or Firm* — Hackler Daghighian Martino & Novak

(57) ABSTRACT

A portable gas filling system for transfer of cryogenic fluids to high pressure gas cylinders includes a moveable platform, a cryogenic fluid pump for connection to an off platform cryogenic fluid Dewar, and a vaporizer for connection between the fluid pump and gas cylinders. A vacuum pump is provided for purging of interconnecting system lines and a gas accumulator interconnected to the system lines enables storage of gas to pressurize the Dewar.

9 Claims, 2 Drawing Sheets

(56) References Cited

U.S. PATENT DOCUMENTS

| | | | | |
|---|---|---|---|---|
| 5,954,101 | A | 9/1999 | Drube et al. | |
| 6,505,469 | B1 | 1/2003 | Drube et al. | |
| 6,609,381 | B1 | 8/2003 | Morgan | |
| 6,886,609 | B2 * | 5/2005 | Cohen et al. | 141/231 |
| 6,923,007 | B1 | 8/2005 | Markham et al. | |
| 2004/0045625 | A1 * | 3/2004 | Gray et al. | 141/4 |
| 2005/0196284 | A1 * | 9/2005 | Gaudet et al. | 417/44.1 |
| 2009/0025288 | A1 * | 1/2009 | Deppermann et al. | 47/58.1 SE |
| 2009/0308083 | A1 * | 12/2009 | Brunner | 62/50.2 |

* cited by examiner

PORTABLE GAS FILLING SYSTEM

The present invention generally relates to transfer systems for cryogenic fluids and is more particularly directed to a portable gas filling system for the transfer of cryogenic fluids at low pressure to high-pressure gas cylinders.

Cryogenic Dewars typically consists of an insulated multiple-walled tank for the storing of cryogenic liquids. Cryogenic liquids can produce large volumes of gas when a liquid is allowed to be vaporized to ambient temperature.

Typically, cryogenic liquids are dispensed from a bulk supply tank to smaller Dewars for use in various applications. Bulk supply tanks are typically stationary and Dewars are transported to the bulk supply for refilling and transported back to the user's site.

Alternatively, a variety of mobile delivery systems have been developed for providing cryogenic liquids to storage tanks at a user's site. Such truck deliveries incur a transportation cost.

The present invention provides for a medical oxygen filling system which provides the opportunity to supply a larger number of locations which reduces the number of high pressure gas cylinders to be transported and also allows the utilization of Dewars to supply product which will reduce cost since the cost of moving the Dewars is ten times more efficient then moving high pressure cylinders.

The system in accordance with the present invention can be used with Dewars or bulk tanks for indoor/outdoor operation.

In addition, the present system provides for virtually no venting of product during operation. This is to be contrasted with current systems which must vent product during operation and provides for high flow capability.

SUMMARY OF THE INVENTION

A portable gas filling system in accordance with the present invention for the transfer of cryogenic fluid at low pressure to high pressure gas cylinders generally includes a movable platform which is readily portable by either forklift or lockable roller wheels which enables the compact design of the present invention to pass through a standard 36 inch door.

A cryogenic fluid pump is disposed in the platform for connection to an off platform cryogenic Dewar and a vacuum pump being oxygen compatible for high purity gas applications is also disposed on the platform.

A vaporizer, also disposed on the platform, is provided for connection between the fluid pump and off platform gas cylinders. Preferably, the vaporizer is an ambient air vaporizer which eliminates the need for additional heating.

The vacuum pump also provides for purging of interconnecting system lines and the gas cylinders.

A gas accumulator, disposed on the platform, is interconnected to the system lines for storage of gas and to enable the pressurizing of the Dewar. Thus, the system in accordance with the present invention is basically a closed system during operation. Current systems must vent during operation to the atmosphere.

More particularly, the present invention includes purging valves, disposed in the system lines, for enabling purging of the lines by the vacuum pump. In addition, filling valves are provided and also disposed in the system lines for cool down of the fluid pump and filling of the gas cylinders.

A vent line is provided along with a gas separator, disposed on the platform, and interconnected with a pump inlet line and the vent line.

A control panel, disposed on the platform, conveniently provides support for pressure gauges along with switches and the filling and purging valves. This provides convenience for operation of the system in accordance with the present invention.

As hereinabove noted the system further comprises of lockable rollers for supporting the platform and enabling manual movement thereof through conventional doors. Alternatively, skids may be provided for moving the platform by a forklift.

BRIEF DESCRIPTION OF THE DRAWINGS

The advantages and features of the present invention will be better understood by the following description when considered in conjunction with the accompanying drawings in which.

DETAILED DESCRIPTION

Figure 1:
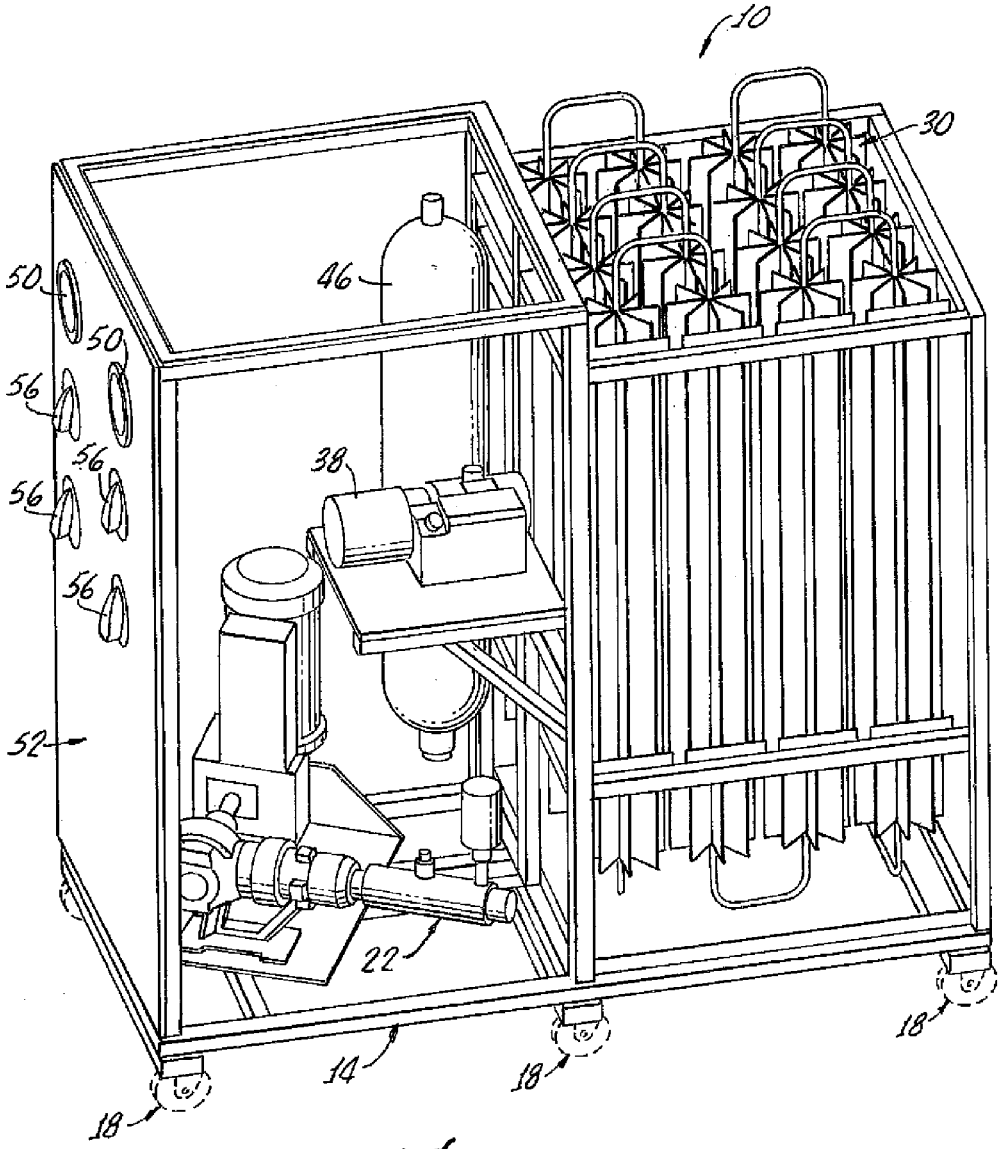
FIG. 1 is a perspective view of a portable gas filling system in accordance with the present invention generally showing a platform, a cryogenic fluid pump, a vaporizer, a vacuum pump, a gas accumulator.
Figure 2:
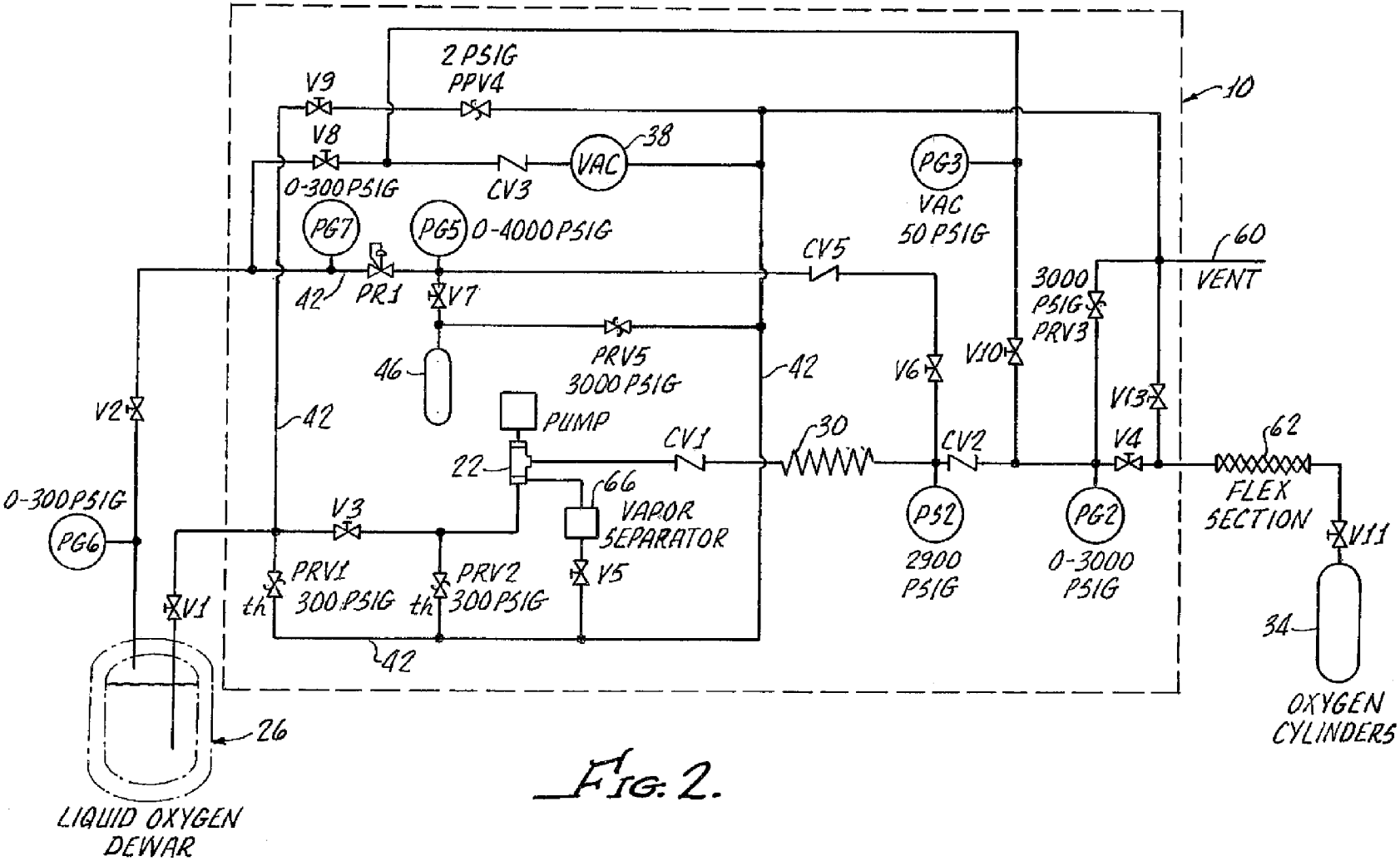
FIG. 2 is a schematic drawing of the components of the present invention.

With reference to FIGS. 1 and 2, there is shown a portable gas filling system 10 in accordance with the present invention for transfer of the cryogenic fluids at low pressure to high pressure gas cylinders. The system 10 generally includes a movable platform 14 having width of up to 36 inches for enablement of the platform with the system 10 thereon to be moved through conventional doors (not shown) via a forklift, not shown, or via lockable rollers 18, see FIG. 1.

A cryogenic fluid pump 22 disposed on the platform is provided for connection with an off platform cryogenic fluid Dewar 26, see FIG. 2.

An ambient air vaporizer 30 is provided and disposed on the platform for connection between the fluid pump and off platform gas cylinders 34.

A vacuum pump 38 also disposed on the platform, is provided for purging of interconnecting system lines 42 and gas cylinders 34.

Importantly, a gas accumulator 46 is provided on the platform and interconnected to the system lines 42 for enabling pressurization of the liquid Dewar 26.

Pressure gauges 50 disposed on a control panel 52 along with valves 56 which are representative of individually identified pressure gauges and valves in FIG. 2 and hereinafter incorporated into a description of the operation of the system 10. A vent line 60 exterior to the system 10 and a flex section 62 provide for interconnection with the system 10. All of the interconnecting lines 42 are not illustrated in the perspective view of FIG. 1 for the sake of clarity.

The schematic drawing of FIG. 2 illustrates the system in terms of conventional fixtures indicated by valves V1 . . . pressure regulator valves PRV1 . . . , pressure gauges PG . . . and one way valves CV1 . . . .

As noted in the FIG. 2, V8, V9, V10, and V13 are provided and disposed in the system lines 42 for enabling purging of the lines 42 by the vacuum pump 38.

In addition, filling valves V1, V2, V4, V3, V5, V6, and V7 also disposed in the system lines 42 are provided for cool down of the fluid pump and filling of the gas cylinders as hereinafter described.

Operation

The following operating instructions are for filing one or more medical oxygen cylinders 34 from the vertical liquid Dewar 26. The Dewar 26 is assumed to be of approximately 200 liter or larger capacity. Refer to FIG. 2 for component tag numbers and arrangement of equipment.

As a starting point it is assumed that all pumps 22, 38 are off, all valves shown in FIG. 2 are closed and the liquid Dewar 26 outlet lines have not been purged. It is also assumed that the system lines 42 has been purged and is filled with a positive pressure of clean oxygen gas between valves V3 and V4.

A. Cylinder Pre-Fill

1. Perform a prefill examination of the target cylinders 34 in accordance with DOT, CGA, and FDA requirements.
2. Connect cylinders 34 to the flex section 62.
3. Attach a temperature indicating device (not shown) to one cylinder 34.

B. Purging of Lines 42 Piping and Equipment

1. Confirm that the liquid oxygen Dewar 26 pressure as indicated on PG6 is at least 25 psig.
2. Start vacuum pump 38
3. Verify PG3 indicates zero pressure
4. Slowly open valve V8
5. Continue vacuum pumping until the pressure indicated on PG3 is approximately 25 inches of Mercury if at sea level. Note that an altitude correction for this reading is required for altitudes significantly above sea level.
6. Close valve V8
7. Open valve V2
8. Slowly open valve V9
9. Continue vacuum pumping until the pressure indicated on PG3 is approximately 25 inches of Mercury if at sea level. Note that an altitude correction for this reading is required for altitudes significantly above sea level.
10. Close valve V9
11. Stop vacuum pump 38
12. Open valve V1

C. Purging of Oxygen Gas Cylinders 34 and Flex Section 62

1. Open valve V13
2. Open all gas cylinder valve(s), V11, and vent cylinder pressure to zero psig.
3. Close valve V13. Leave valve(s) V11 open
4. Start vacuum pump 38
5. Open valve V10

Note: If PG3 shows any positive pressure when opening valve V10 immediately close this valve and continue venting cylinders through valve V13.

6. Continue vacuum pumping until the target cylinders 34 to be filled have achieved a vacuum equivalent of 25 inches of Mercury at sea level. Use an appropriate vacuum correction chart when filling at altitudes above sea level.
7. Close valve V10
8. Stop vacuum pump
9. Open valve V4

D. Cool Down of Liquid Oxygen Pump 22 and Gas Cylinder 34 Filling

1. Open valve V3, V6, and V7
2. Using pressure regulator PR1, set the liquid Dewar 26 pressure as shown on PG7 at approximately 60 psig above the saturation pressure in the Dewar 26.
3. This will initiate cool down and prime of the liquid oxygen pump.
4. Open valve V5
5. Subsequently, start the liquid oxygen pump 22 and confirm that the pump 22 is primed and gas is flowing to the gas cylinders 34.
6. Fill the target cylinders 34 at a rate no faster than 100 psig pressure rise per minute.

Note: Discontinue filling the target cylinders 34 if the cylinder 34 temperature reaches 120 degrees Fahrenheit.

7. Follow procedures to perform cylinder 34 leak checks.
8. Based on using an appropriate pressure temperature chart stop the cylinder 34 fill process when the gas cylinders 34 reach full pressure (usually between 2100 and 2600 psig), by stopping the pump 22. Note that the pump 22 will stop automatically if the pressure at PS2 reaches 2900 psig,
9. Close valve V4
10. Close cylinder valve(s) V11
11. Open valve V13 to vent residual pressure from cylinder filling rack
12. Remove filled gas cylinders 34 from the filling section 62
13. Follow FDA procedures for quarantine and product analysis E. Filling of Additional Gas Cylinders 1. Perform Steps A1 through A3
2. Perform steps C1 through C9
3. Start the liquid oxygen pump
4. Perform steps D6 through D13

F. Shutdown of System

1. Close valves V1, V2, V6, and V7
2. When venting of liquid and low pressure gaseous oxygen is complete, close valves V3 and V5.
3. Set pressure regulator PR1 to zero psig
4. Vent residual pressure on Dewar 26 vent line by slowly opening valve V8. Once gauge PG7 indicates approximately 3 psig pressure or less, close valve V8.
5. Vent residual pressure on Dewar 26 liquid line by slowly opening valve V9. Once venting is complete, close valve V9.

Although there has been hereinabove described a specific portable gas filling system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A portable gas filling system for transfer of cryogenic fluids at low pressure to high pressure gas cylinders, the system comprising:

a movable platform;

a cryogenic fluid pump, disposed on the platform, configured to be connectable to an off platform cryogenic fluid Dewar;

a vaporizer, disposed on the platform, configured to be connectable between the fluid pump and an off platform gas cylinder;

a vacuum pump, disposed on the platform, configured for purging of interconnecting system lines; and a gas accumulator disposed on the platform configured for enabling storage of gas and connected to a gas return line configured for pressurization of the Dewar;

wherein at least a width of the movable platform is less than 36 inches wherein the portable gas filling system including the cryogenic fluid pump, the vaporizer, the vacuum pump and the gas accumulator are also within the 36 inch width of the movable platform.

2. The system according to claim 1 further comprising purging valves disposed in the system lines for enabling purging of the lines by said vacuum pump.

3. The system according to claim 2 further comprising filling valves disposed in the system lines for cool down of the fluid pump and filling of the gas cylinders.

4. The system according to claim 3 further comprising a vent line and a vapor separator disposed on the platform and interconnecting the fluid pump and the vent line.

5. The system according to claim 4 further comprises a control panel, disposed on the platform, for supporting pressure gauges, switches and the filling and purging valves.

6. The system according to claim 5 wherein said vaporizer comprises an ambient air vaporizer.

7. The system according to claim 6 further comprising lockable roller wheels for supporting the platform.

8. The system according to claim 1, wherein the movable platform is configured to pass through a standard 36 inch door.

9. A portable gas filling system for transfer of cryogenic fluids at low pressure to high pressure gas cylinders, the system comprising:

a movable platform configured to pass through a standard 36 inch door;

a cryogenic fluid pump on the platform configured to be connectable to an off platform cryogenic fluid Dewar;

a vaporizer on the platform configured to be connectable between the fluid pump and an off platform gas cylinder;

a vacuum pump on the platform configured for purging of interconnecting system lines; and a gas accumulator on the platform configured for enabling storage of gas and connected to a gas return line configured for pressurization of the Dewar;

wherein the movable platform, the cryogenic fluid pump, the vaporizer, the vacuum pump and the gas accumulator are all configured as the portable gas filling system to have at least one width less than 36 inches.

* * * * *